United States Patent [19]

Reinwald et al.

[11] 4,179,268

[45] Dec. 18, 1979

[54] METHOD OF MACHINE WASHING OF SOLID SOILED MATERIALS BY REVERSIBLY CONTACTING THE CIRCULATING WASH LIQUID WITH ALUMINOSILICATES

[75] Inventors: Elmar Reinwald, Dusseldorf; Heinz Smolka, Langenfeld; Milan J. Schwuger, Haan; Edgar Koppelmann, Hilden, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 852,028

[22] Filed: Nov. 16, 1977

[30] Foreign Application Priority Data

Nov. 25, 1976 [DE] Fed. Rep. of Germany ..... 2653479

[51] Int. Cl.[2] ..... B08B 3/00; C02B 1/00

[52] U.S. Cl. ..... 8/137; 252/131; 252/179; 68/18 F

[58] Field of Search ..... 8/137; 252/131, 179

[56] References Cited

U.S. PATENT DOCUMENTS

| | | | |
|---|---|---|---|
| 3,030,181 | 4/1962 | Milton | 252/179 |
| 3,424,545 | 1/1969 | Bauman | 8/137 |
| 3,755,180 | 8/1973 | Austin | 8/108 |
| 3,925,262 | 12/1975 | Laughlin et al. | 252/526 |
| 3,962,132 | 6/1976 | Haschke et al. | 252/430 |
| 4,066,393 | 1/1978 | Morey et al. | 8/137 |

FOREIGN PATENT DOCUMENTS

| | | |
|---|---|---|
| 812116 | 9/1974 | Belgium . |
| 2055423 | 5/1972 | Fed. Rep. of Germany . |
| 7304401 | 10/1973 | Netherlands . |
| 7304854 | 10/1973 | Netherlands . |

*Primary Examiner*—A. Lionel Clingman
*Attorney, Agent, or Firm*—Hammond & Littell

[57] ABSTRACT

An improvement in the machine washing of solid soiled materials comprising withdrawing and recycling the wash liquor in contact with said solid soiled materials through a silicate cation exchange compound having some combined water and a particle size of at least 10μ of the formula:

$$(M_{2/n}O)_x.Me_2O_3.(SiO_2)_y$$

wherein M is a cation of valence n exchangeable with calcium, Me is a member selected from aluminum and boron, x is a number from 0.7 to 1.5 and y is a number from 0.8 to 6, said silicate compound having a calcium binding power of at least 50 mg of CaO per gram, said silicate compound being maintained out of contact with said solid soiled materials, for such time that the recycling wash liquor has passed through said silicate compound at least twice, in the presence of other soluble washing and cleaning compounds, while reversing the direction of flow of said wash liquor through said silicate compound repeatedly.

12 Claims, 4 Drawing Figures

FIG. I
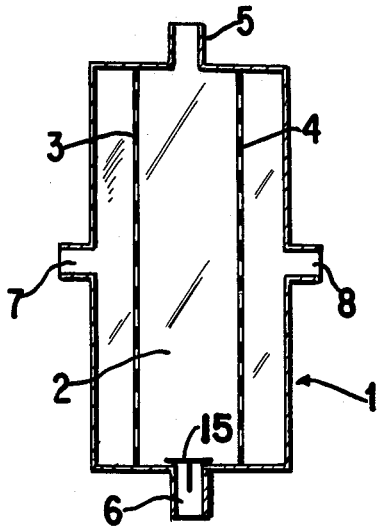
FIG. II
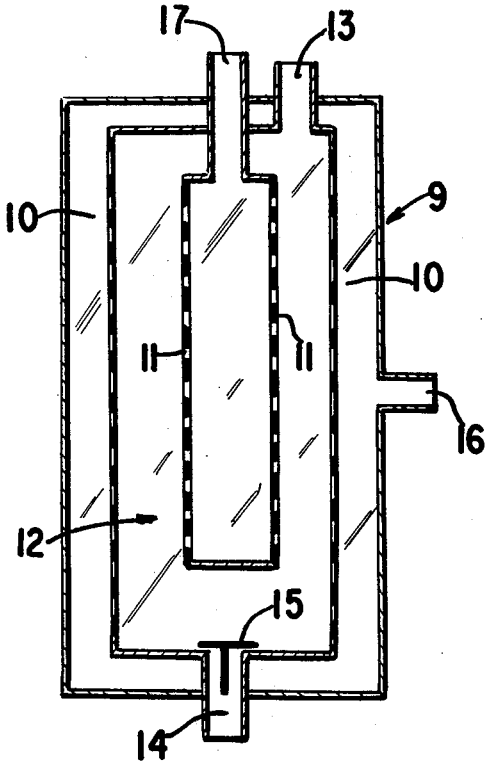

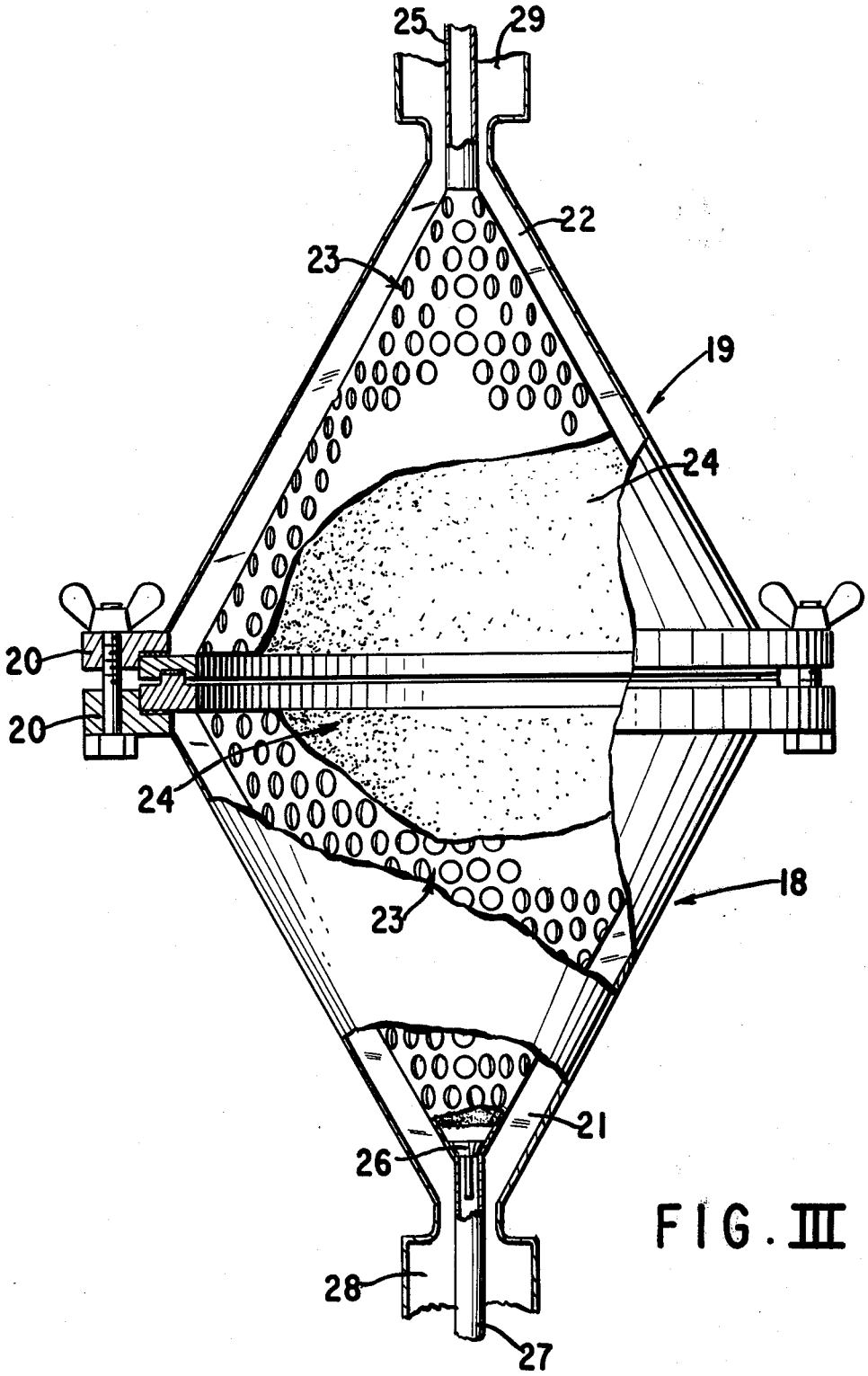
FIG. III

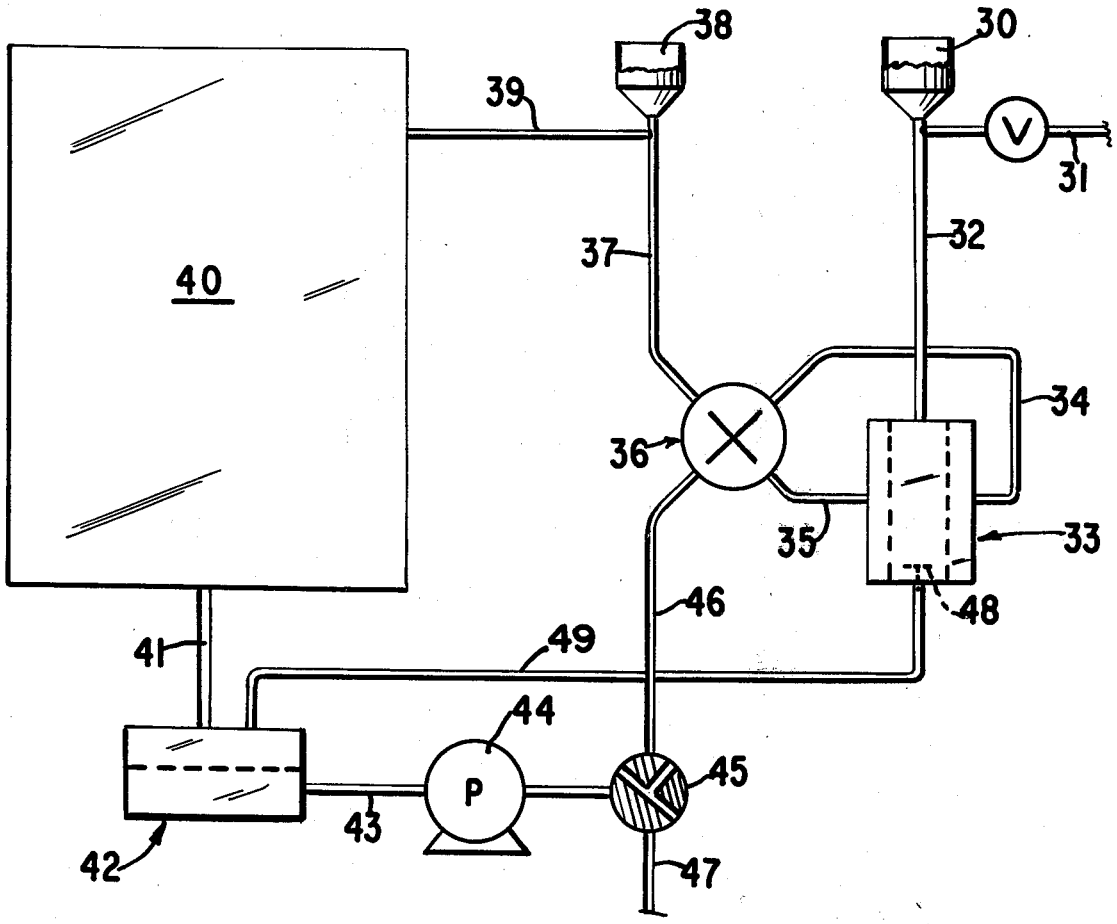
FIG. IV

METHOD OF MACHINE WASHING OF SOLID SOILED MATERIALS BY REVERSIBLY CONTACTING THE CIRCULATING WASH LIQUID WITH ALUMINOSILICATES

THE RELATED ART

Washing methods are known where the washing solution is circulated continuously during the washing process and conducted through one or more vessels in which the entrained dirt particles can settle from the wash water liquor before it is returned into the washing process. It has already been suggested to place screens or filters in the liquid circuit to retain coarse impurities or objects which could damage the mechanism. But since the bulk of the dirt is usually dissolved or dispersed in very finely divided form in the solution, the cleaning or regeneration of the solution is inadequate this way, and savings in certain washing and cleaning ingredients, for example, polymeric phosphates, cannot be achieved without a simultaneous decrease in the cleaning results.

In commercial laundries it is customary to prepare the washing solution with softened water, to which end the water to be used is first treated with an ion-exchange compound (e.g., a zeolite). But soft water has not sufficient washing power, even in the presence of surface-active substances to clean textiles and dishes in the absence of builders.

The problem is particularly serious when the articles to be washed carry soil which contains hardness formers, a pre-treatment of the wash water does not affect the hardness thereby introduced. This results in progressive incrustation of the material being washed.

Furthermore it has been suggested to effect the washing process in the presence of ion-exchangers based on organic polymers, which are added to the washing solution either in the form of a textile or as granular or powdered resins. But textile-type ion-exchangers have only a relatively low ion-exchange capacity, so that large amounts of the ion-exchange textile are required. Almost any amount of hardness is detrimental to washing solutions which contain an anionic detergent, and in most areas where hardness is a significant problem, it is necessary to decrease the hardness of the water by at least 50%. The space occupied by the ion-exchanger is at the expense of the material to be cleaned. Granular or powdered ion-exchange agents become caught in fabrics or garments being washed unless special precautions are taken, and the particles are difficult to recover when the washing operation is completed. If, as has likewise been suggested, the ion-exchange resin is enclosed in a guaze bag to prevent the agent from depositing on the textile fibers, the cleaning effect of the washing solution is considerably decreased.

U.S. patent application Ser. No. 458,306, filed Apr. 5, 1974, now abandoned in favor of continuation Application Ser. No. 800,308, filed May 25, 1977, now abandoned in favor of Continuation-in-part Application Ser. No. 956,851, filed Nov. 2, 1978, discloses that the cleansing effected in the machine washing of laundry with detergent solutions is greatly improved when washing solutions have a uniformly distributed content of certain finely-divided ion-exchange aluminosilicates. It was found that these silicates have the capability of rapidly binding not only the calcium hardness ions which are normally present in the make-up water, but that they also have the capability of rapidly binding the hardness-imparting ions which become present in the water as the calcium-containing soil in the garments is solubilized.

It was believed, however, that to inactivate the calcium ions solubilized from the soil before these ions could react with and precipitate the anionic detergents usually present in the washing solution, the aluminosilicate must be present in direct or virtually direct contact with the fibers as the washing operation proceeded. It was seen that as a result, a considerable number of these particles become deposited within the textile fibers and in the pockets and seams of the garments, and this was a disadvantage of the process.

U.S. patent application Ser. No. 618,461, filed Oct. 1, 1975, now abandoned in favor of Continuation Application Ser. No. 872,561, filed Jan. 26, 1978, discloses a method of machine washing and cleaning of solid materials with the use of low-phosphate or phosphate-free washing and cleaning solutions in the presence of water-insoluble cation exchangers which are able to bind the hardness formers of the water and of the impurities, characterized in that the cation exchanger has a calcium binding capacity of at least 50 mg CaO/gm and consists of a compound, containing combined water, of the formula $$(M_{2/n}O)_x.Me_2O_3.(SiO_2)_y$$

where M is a cation, exchangeable with calcium, of the valence n; x is a number from 0.7 to 1.5, Me is boron or aluminum; and y is a number from 0.8 to 6; where the wash liquid is passed continuously or intermittently through an adsorption device which is adapted to separate the cation exchanger from the wash liquid.

According to this application, the washing and cleaning process can be performed, for example, by first adding the aluminosilicate simultaneously with a washing and cleaning agent, or respectively, in mixture therewith, to the cleaning liquid, and bringing this aluminosilicate containing wash solution in direct contact with the substrate. The aluminosilicate is collected in the adsorption device during the washing process, or at the latest before the start of rinsing. The invention claimed in this application is to collect the aluminosilicate in the adsorption device, already before the addition of the material to be washed or cleaned, thereby excluding direct contact of the material to be cleaned with the insoluble ion-exchanger. In this procedure there occurs a certain presoftening of the wash liquid containing the cleaning agent, before it comes in contact with the material to be cleaned.

Tests indicate that by this process, aluminosilicates of the larger particle sizes can be employed while obtaining excellent wash results, which results are as good as the results obtained by the use of smaller particle sized aluminosilicates in direct contact with the materials being washed.

Suitable absorption devices for the process of this prior art are, in addition to simple plate filters and filter cartridges, which may optionally be charged with filter aids to improve the efficiency of the filter and to avoid clogging of the filter pores, the so-called fluid bed or whirlpool filters as a preferred embodiment.

In this filter type, the liquid to be filtered enters the interior of the filter chamber tangentially and thus maintains the aluminosilicate to be separated in continuous whirling motion. This greatly reduces the danger of the filter pores clogging and the liquid circulation, which is vital for a good laundry result, being throttled or even suppressed. Nevertheless, in the presence of relatively large quantities of finely-divided dirt particles, or when using especially active aluminosilicates with a high percentage of finely pulverized material, difficulties may arise. These can be obviated by intermittently reversing the flow direction, but then it must be accepted that a part of the aluminosilicate already separated or of the filtered dirt substances are flushed back into the laundry tub, owing to which the washing process as a whole will be lengthened and will require frequent rinsing. This disadvantage can be circumvented by using the aluminosilicate in the form of a lumpy material or a filter cartridge or filter plate, which will remain in the adsorption device even if the flow is reversed. However, due to the reduced effective surface, in the case of coarse-grained or lumpy material, the cation exchange is retarded or more sluggish and the washing process is lengthened proportionately. Moreover, the production of porous filter plates and cartridges is comparatively expensive.

OBJECTS OF THE INVENTION

An object of the present invention is the development of a process for washing solid soiled materials employing smaller particle sized aluminosilicates wherein an enhanced washing effect is had without clogging the filter pores.

Another object of the present invention is the development of a method for machine washing and cleaning of solid materials utilizing washing and cleaning solutions in the presence of water-insoluble cation exchange agents which are capable of binding the hardness components of the water and the soil, comprising withdrawing and recycling the wash liquid in contact with said solid soiled materials through a silicate cation exchange compound having some combined water and a particle size of between 10μ and 1000μ of the formula:

$$(M_{2/n}O)_x.Me_2O_3.(SiO_2)_y$$

wherein M is a cation of valence n exchangeable with calcium, Me is a member selected from aluminum and boron, x is a number from 0.7 to 1.5 and y is a number from 0.8 to 6, said agent having a calcium binding power of at least 50 mg of CaO per gram, said silicate cation exchange compound being maintained completely out of contact with said solid soiled materials in a separate area from the washing area, said wash liquor at some time during said recycling containing soluble washing and cleaning compounds and washing said solid materials while continuing the recycling of the wash liquor through said silicate cation exchange compound, wherein the total amount of washing liquor is continuously or intermittently cyclically circulated from the washing area through the separate area with the cation exchange compound and then back to the washing area at least five times during the cleaning process, and during this period the direction of flow of said wash liquor through said silicate compound is reversed repeatedly, and where the amount of the cation exchange compound is 0.2 gm to 10 gm per liter of washing solution, and said washing solution contains from 0.2 to 10 gm per liter of other soluble washing and cleaning compounds, whereby said silicate cation exchange compound is never in contact with said solid materials.

These and other objects of the present invention will become more apparent as the description thereof proceeds.

THE DRAWINGS

FIG. I is a diagrammatic cross-section of one embodiment of a filter employed in the process of the invention.

FIG. II is a diagrammatic cross-section of another embodiment of a filter employed in the process of the invention.

FIG. III is a partial cross-section of another embodiment of a filter employed in the process of the invention.

FIG. IV is a flow diagram of the process according to the invention.

DESCRIPTION OF THE INVENTION

We have now found that the cleaning results as described in Ser. No. 618,461 can be further enhanced by proceeding in the manner described below. The subject of the invention is a method according to Ser. No. 616,461, characterized in that, before the start of the washing process, the aluminosilicate present in powdery or fine grain form is transferred into a filter area completely separate from the washing area and during the washing process, the flow direction of the wash liquor passing through the filter area is reversed repeatedly.

More particularly, the present invention relates to a method for machine washing and cleaning of solid materials utilizing washing and cleaning solutions in the presence of water-insoluble cation exchange agents which are capable of binding the hardness components of the water and the soil, comprising withdrawing and recycling the wash liquor in contact with said solid soiled materials through a silicate cation exchange compound having some combined water and a particle size of between 10μ and 1000μ of the formula:

$$(M_{2/n}O)_x.Me_2O_3.(SiO_2)_y$$

wherein M is a cation of valence n exchangeable with calcium, Me is a member selected from aluminum and boron, x is a number from 0.7 to 1.5 and y is a number from 0.8 to 6, said agent having a calcium binding power of at least 50 mg of CaO/gm, said silicate cation exchange compound being maintained completely out of contact with said solid soiled materials in a separate area from the washing area, said wash liquor at some time during said recycling containing soluble washing and cleaning compounds and washing said solid materials while continuing the recycling of the wash liqur through said silicate cation exchange compound, wherein the total amount of washing liquor is continuously or intermittently cyclically circulated from the washing area through the separate area with the cation exchange compound and then back to the washing area at least five times during the cleaning process, and during this period the direction of flow of said wash liquor through said silicate compound is reversed repeatedly, and where the amount of the cation exchange compound is 0.2 gm to 10 gm per liter of washing solution, and said washing solution contains from 0.2 to 10 gm per liter of other soluble washing and cleaning compounds, whereby said silicate cation exchange compound is never in contact with said solid materials.

The term "completely out of contact with said soiled solid materials in a separate area from the washing area" means that the cleaning solution cycled through the aluminosilicate exchanger passes, independently of the respective flow direction through a filter which is impenetrable by the aluminosilicate before it is again brought in contact with the material to be cleaned. The filter is to be impenetrable for those particles which, due to their size, settle relatively fast in the cleaning solution and thus can precipitate on the fiber or on the dishes to be washed or other material. Solid particles which due to their much smaller size form a stable suspension in the cleaning solution, and as a result do not tend to form adhering precipitates on the material to be cleaned or, respectively, on the cleaning units, can pass through the filter.

According to the invention, however, aluminosilicates are preferred which are free from very fine-grained components, i.e., of those of a grain size of less than 5μ to 10μ and whose average grain size is above 20μ, and in particular above 30μ. Especially suitable are aluminosilicates which are fine-grained starting materials granulates with a binder which is water-insoluble but swellable in water. Suitable granulated materials have, for example, a grain spectrum of 30μ to 1 mm with a maximum at 50μ to 200μ. Particle sizes of over 1000μ should be avoided.

The optional softening of the tap water wash liquid, which precedes the addition of washing and cleaning agent, can be done by having the entire charge of the fresh water flow with the aluminosilicate into the filter device and collecting the aluminosilicate in the adsorption device while passing the water into the washing area. This operation is sufficient to materially reduce the hardness of the wash water before addition of the surface-active agents and water-soluble sequestrants. If desired, further soltening can be effected by recycling the wash water until the desired degree of softness is obtained before charging the detergent.

Of particular advantage, is the use of a detergent composition which contains an anionic surface-active compound and a substoichiometric amount of a water-soluble sequestering agent. The aqueous wash solution should contain from 0.1 to 1 gm/liter of an anionic surface-active compound and 0.5 gm/l. to 2 gm/l. of a water-soluble sequestering agent for calcium as an assistant or adjuvant for the ion-exchange agent.

It is usually necessary that the amount of cationic exchange aluminosilicate used be sufficient to bind substantially all of the hardness present.

The process of the invention can be performed in a conventional machine washer which comprises in combination a tub adapted to contain the objects to be washed, a conduit having a pump therein adapted to circulate washing solution from one portion of said tub to another portion of said tub, and a special vessel in said conduit adapted to completely contain said ion-exchange agent having a particle size in excess of 10μ even when the flow direction is reversed. The vessel is hereinafter sometimes for convenience termed a "filter", but it will be understood that in each instance it also performs the function of binding the ions which cause hardness in water.

In practicing the method of the invention, a silicate cation exchanger compound is employed having a particle size of between 10μ and 1000μ, a calcium binding capacity of at least 50 mg CaO/gm on an anhydrous basis and the formula $$(M_{2/n}O)_x.Me_2O_3.(SiO_2)_y$$

wherein M denotes a water-soluble cation of valence n exchangeable with calcium, x denotes a number from 0.7 to 1.5, Me denotes boron or aluminum, and y denotes a number from 0.8 to 6, said silicate cation exchanger compound containing some combined water.

Compounds in which Me=Al and y=1.3 to 3.3 are preferred. Their calcium binding capacity is preferably 100 to 200 mg CaO/gm on the anhydrous basis. They are hereafter called "aluminosilicates" for brevity.

Sodium is preferred as the cation, followed by lithium, potassium, ammonium or magnesium, as well as the cation of water-soluble organic basis, e.g., those of primary, secondary or tertiary alkylamines or alkylolamines with not more than two carbon atoms per alkyl radical, or not more than three carbon atoms per alkylol radical. Preferably M is an alkali metal, especially sodium.

Aluminosilicates of the type described above are commercially available and are produced synthetically in a simple manner, for example, by reacting water-soluble silicates with water-soluble aluminates in the presence of water. Thus, aqueous solutions of the starting materials can be mixed with each other, or one component which is present in solid form can be reacted with the other component which is present as in dissolved state. By mixing both components in solid form in the presence of water, the desired aluminosilicates are also obtained. Aluminosilicates can also be obtained from $Al(OH)_3$, $Al_2O_3$ or $SiO_2$ by reacting them with alkali metal silicate or alkali metal aluminate solutions, respectively. Particularly effective aluminosilicates are formed if the special precipitation conditions are observed which are described in detail in said copending Application Ser. No. 458,306. In similar manner the boron analogues can be formed.

The aluminosilicates produced by precipitation or transformed in finely divided form into aqueous suspension by other methods are transformed by heating to temperatures of 50° C. to 200° C. from the amorphous into the aged or crystalline state. Crystalline aluminum silicates are preferred for the purposes of the invention. Particularly suitable are aluminosilicates of the composition:

0.7 to 1.1 $Na_2O.Al_2O_3.1.3$ to 3.3 $SiO_2$

The crystalline aluminosilicate which is present in aqueous suspension can be separated by filtration from the remaining aqueous solution and dried at temperatures of 50° C. to 400° C. (preferably 80° to 200° C.). The product after drying contains more or less bound water.

The water-containing aluminosilicates thus produced after the disintegration of the dried filter cake are obtained as a fine powder whose primary particle size does not exceed 0.1 mm, but which is mostly less, down to 10μ. It must be kept in mind that the primary particles can be agglomerated to larger structures.

A method of improving the filtering capacity of the aluminosilicates, if desired, consists in using filter aids, like kieselguhr (silica), diatomaceous earth, pumice powder, cellulose, or finely ground plastic foam. The aluminosilicate can also be deposited or adsorbed on these porous materials, improving the filtering capacity during the production or after in order to increase this way the particle size.

The process of the present invention is ordinarily used with waters which have a normal hardness in excess of about 80 mg of CaO equivalent per liter, i.e., with waters which have an initial hardness of the amount or which develop this hardness as the washing proceeds.

The amount of aluminosilicate required to obtain a good washing or cleaning effect depends, on the one hand, on its calcium binding power, and on the other hand, on the amount of dirt in the materials to be washed and on the hardness and the amount of water used.

In order to obtain an optimum washing or cleaning effect, it is advisable to use a certain excess of aluminosilicate, particularly in the case of greatly soiled substrates, in order to completely or partly bind the hardness formers contained in the released dirt. In most instances, accordingly, the amount used per cleaning cycle ranges between 0.2 to 10 gm of aluminosilicate, particularly 1 to 6 gm of aluminosilicate per liter of wash water, so as to maintain the hardness of the wash solution as close to zero as is practicable.

It was also found that the dirt can be removed much faster and/or more completely if a water-soluble substance is added to the aqueous solution of detergent which exerts a sequestering (i.e., a complex-forming) and/or precipitating effect on the calcium obtained in the soil. Suitable as sequestering agents for calcium for the purposes of the invention are also substances with such a low sequestering power that they were not considered heretofore as typical sequestering agents for calcium, but these compounds are frequently capable of delaying the precipitation of calcium carbonate from aqueous solutions. The sequestrants or precipitants binding calcium ions can be present in substoichiometric amounts, related to the hardness formers present. They act as "carriers," that is, their calcium salts are transformed into soluble salts by contact with the ion-exchanger and they are thus again available as sequestrants.

Preferably small amounts of sequestrants or precipitants for calcium are used, e.g., 0.05 to 2 gm/liter in order to speed up or improve the removal of impurities. Particularly, amounts of 0.1 to 1 gm/liter are used. Substantially larger amounts can also be used, but in the case of phosphorus-containing sequestrants or precipitants the amounts should be so selected that the phosphorus load of the waste water is less than with the use of the customary detergents based on tripolyphosphate.

The sequestrants or precipitants comprise those of an inorganic nature such as the water-soluble alkali metal (particularly the sodium) and ammonium pyrophosphates, tripolyphosphate, higher polyphosphates, and metaphosphates.

Organic compounds which act as sequestrants or precipitants for calcium include the water-soluble polycarboxylic acids, hydroxycarboxylic acids, aminocarboxylic acids, carboxyalkyl ethers, polyanionic polymers and water-soluble salts thereof, particularly the polymeric carboxylic acids and the phosphonic acids, which are used as acids, alkali metal or aluminum salts and preferably as sodium salts.

Examples of polycarboxylic acids are dicarboxylic acids of the general formula $$HOOC—(CH_2)_n—COOH$$

wherein n=0 to 8, in addition, maleic acid, methylenemalonic acid, citraconic acid, mesaconic acid, itaconic acid, acyclic polycarboxylic acids with at least three carboxyl groups in the molecule, such as, for example, tricarballylic acid, aconitic acid, ethylene tetracarboxylic acid, 1,1,3,3-propanetetracarboxylic acid, 1,1,3,3,5,5-pentanehexacarboxylic acid, hexanehexacarboxylic acid, cyclic di- or polycarboxylic acids, such as, for example, cyclopentanetetracarboxylic acid, cyclohexanehexacarboxylic acid, tetrahydrofurantetracarboxylic acid, phthalic acid, terephthalic acid, benzene-tri-, tetra- or pentacarboxylic acid, as well as mellitic acid.

Examples of hydroxymono- or polycarboxylic acids are glycolic acid, lactic acid, malic acid, tartronic acid, methyl tartronic acid, gluconic acid, glyceric acid, citric acid, tartaric acid, and salicylic acid.

Examples of aminocarboxylic acids are glycine, glycolglycine, alanine, asparagine, glutamic acid, aminobenzoic acid, iminodi- or triacetic acid, (hydroxyethyl)-iminodiacetic acid, ethylenediaminetetraacetic acid, (hydroxyethyl)-ethylenediaminetriacetic acid, diethylenetriaminepentaacetic acid, as well as higher homologues, which can be obtained by polymerization of an N-aziridylcarboxylic acid derivative, e.g., acetic acid, succinic acid, tricarballylic acid and subsequent saponification or by condensation of polyimines with a molecular weight of 500 to 10,000 with salts of chloracetic or bromoacetic acid.

Examples of carboxyalkyl ethers are 2,2-oxydisuccinic acid and other ether polycarboxylic acids, particularly polycarboxylic acids containing carboxymethyl ether groups which comprise corresponding derivatives of the following polyvalent alcohols or hydroxycarboxylic acids, which can be completely or partly etherified with glycolic acid:

glycol
di- or triglycols
glycerin
di- or triglycerin
glycerin monomethyl ether
2,2-dihydroxymethyl-propanol
(1,1,1-trihydroxymethyl)-ethane
(1,1,1-trihydroxymethyl)-propane
erythrite
pentaerythrite
glycolic acid
lactic acid
tartronic acid
methyltartronic acid
tartaric acid
trihydroxy glutaric acid
saccharic acid
mucic acid.

As transition types to the polymeric carboxylic acids are the carboxymethyl ethers of sugar, starch and cellulose.

Among the polymeric carboxylic acids, the polymers of acrylic acid, hydroxyacrylic acid, maleic acid, itaconic acid, mesaconic acid, aconitic acid, methylene malonic acid, citraconic acid, etc., the copolymers of the above-mentioned carboxylic acids with each other or with ethylenically unsaturated compounds, such as ethylene, propylene, isobutylene, vinyl alcohol, vinyl methyl ether, furan, acrolein, vinyl acetate, acrylamide, acrylonitrile, methacrylic acid, crotonic acid, etc., such as the 1:1 copolymers of maleic acid anhydride and ethylene or propylene or furan, play a special role.

Other polymeric carboxylic acids of the type of the polyhydroxypolycarboxylic acids or polyaldehydopolycarboxylic acids are substantially substances composed of acrylic acid and acrolein units or acrylic acid and vinyl alcohol units which can be obtained by copolymerization of acrylic acid and acrolein or by polymerization of acrolein and subsequent Cannizzaro reaction, if necessary, in the presence of formaldehyde.

Examples of phosphorus-containing organic sequestrants are alkane-polyphosphonic acid, amine- and hydroxyalkane polyphosphonic acids and phosphono-carboxylic acid, such as:

methane diphosphonic acid
propane-1,2,3-triphosphonic acid
butane-1,2,3,4-tetraphosphonic acid,
polyvinyl phosphonic acid
1-amino-ethane-1,1-diphosphonic acid
1-amino-1-phenyl-1,1-diphosphonic acid
aminotrimethylene phosphonic acid
methylamine- or ethylamine-dimethylene phosphonic acid
ethylene-diaminetetramethylene phosphonic acid
1-hydroxyethane-1,1-diphosphonic acid
phosphonoacetic acid
phosphonopropionic acid
1-phosphonoethane-1,2-dicarboxylic acid
2-phosphonopropane-2,3-dicarboxylic acid
2-phosphonobutane-1,2,4-tricarboxylic acid
2-phosphonobutane-2,3,4-tricarboxylic acid, as well as copolymers of vinyl phosphonic acid and acrylic acid.

The process of the present invention permits a reduction in the use of phosphorus containing inorganic or organic sequestrants or precipitants to a content of inorganically or organically combined phosphorus in the treatment liquors to less than 0.6 gm/liter, and preferably to less than 0.3 gm/liter, or the working of the process completely without phosphorus-containing compounds.

The process of the present invention is usefully applied to waters of any given objectionable level of hardness.

Apart from washing textiles, which is the preferred field of application, the method and the device according to the invention are also suitable for any other cleaning operations where it is possible or of advantage to return or regenerate the tap water or the cleaning solution. These applications comprise the cleaning of instruments, apparatus, pipe lines, boilers and vessels of any material, such as glass, ceramic material, enamel, metal or plastic. An example is the industrial cleaning of bottles, drums and tank cars. The method is also particularly suitable for use in commercial or household dishwashing machines.

Depending on the use, customary surfactants, builder substances which increase the cleaning power, bleaching agents, as well as compounds which stabilize or activate such bleaching agents, soil-suspension agents or greying inhibitors, optical brighteners, biocides or bacteriostatic substances, enzymes, foam inhibitors, corrosion inhibitors and substances regulating the pH value of the solution can be present in the washing and cleaning process. Such substances, which are normally present in varying amounts in the washing, rinsing and cleaning agents, are listed specifically in Ser. No. 458,306.

When using one or more of the above-mentioned substances which are generally present in cleaning liquors, the following concentrations are preferably maintained:

| Grams per liter | |
|---|---|
| 0.1 to 2.5 | surfactants |
| 0.01 to 3 | sequestrants |
| 0 to 3 | other builder substances |
| 0 to 0.4 | active oxygen or equivalent amounts of active chlorine. |

The pH of the treatment liquors can range from 6 to 13, depending on the substrate to be washed or cleaned; preferably it is between 8.5 and 12.

The treatment temperature can vary within wide limits and is between 20° C. and 100° C. Since the washing and cleaning effect is already very high at low temperatures, that is, between 30° C. and 40° C., and exceeds that of conventional detergents and methods, it is possible to wash very delicate fabrics in this range, e.g., those of wool or silk or very fine porcelain dishes with a very delicate overglaze or gold trim without damaging them.

The washing or cleaning time at the anticipated treatment temperature depends on the degree of soiling, the exchange rate, and the output of the pump. It can, therefore, vary within wide limits, for example, from five minutes or two hours. Preferably, it is between 10 and 60 minutes as this is usually sufficient to effect substantially complete removal of soil. The output of the pump and of the filter are preferably so selected that the cleaning solution is circulated at least twice during the washing period. The washing solution should pass at least five times and preferably ten to about fifty times through the filter charged with the aluminosilicate. This output should also be achieved if the filter becomes partially clogged by the deposited material and has become difficult to penetrate.

It is, therefore, advisable to use pumps which still assure a sufficient output at a certain back-pressure, e.g., of 1 to 2 atmospheres above normal.

The pore size of the filter depends on the particle size of the aluminosilicate. Since the deposited material or the additionally used filter aid have also a filter effect, the pore size can be greater than corresponds to the particle size of the fine portions in the interest of a lower flow resistance. With a mean particle size of the aluminosilicate of 10 to 50μ, the pore size of the filter can, therefore, be 50 to 150μ, for example, preferably 80 to 120μ, which also applies to the case where the particle size is relatively wide.

The device (i.e., the apparatus) according to the invention consists at least of the following components:

(a) A washing or cleaning unit or dishwashing unit which may be of a conventional or modified construction,
(b) A cycle system equipped with a circulating pump,
(c) At least one adsorption device, such as a filter unit in the cycle system for completely containing the calcium binding agent.

Moreover, the following arrangements have proved successful for the practice of the process of the invention:

(d) A fresh water inlet, connected with the adsorption device, and (e) A feeding or proportioning device for the washing and cleaning agent, disposed in the cycle system.

The invention is further illustrated by the drawings wherein:

FIGS. I and II are diagrammatic cross-sections of filter embodiments for practicing the process according to the present invention;

FIG. III is a partial cross-section of another filter embodiment, and

FIG. IV is a flow diagram of the process of the invention.

FIG. I shows diagrammatically a counter-current filter in transverse section. It consists of the filter housing 1, the filter chamber 2, which is defined by the two filter plates 3 and 4, the filling pipe 5 and the drain pipe 6 provided with a check valve 15, for the aluminosilicate, as well as the two connections 7 and 8 for the cycled cleaning solution. For operation the aluminosilicate is transferred into the filter chamber 2 through pipe 5. In the first phase the cleaning liquid enters the filter through the inlet 7 and leaves it through the connection 8. In the second phase the liquid is conducted in the opposite direction. As a result of the flow reversal, the material previously deposited on the filter is lifted off and loosened. By repeating this flow reversal several times, the filter remains penetrable. After termination of the washing process, the bottom valve 15 having been opened, the aluminosilicate is discharged through the drain pipe 6. For complete cleaning of the filter, the cleaning solution no longer needed is conducted either alternately or simultaneously through the inlets 7 and 8 into the filter and evacuated via pipe 6.

The illustrated principle may be modified in various ways. Thus it is possible, for example, to integrate the filter in a separate wash liquor container of the washing or dishwashing machine. With such a concentration, one side of the filter housing with the associated feed pipe, in the drawing, for example, the right housing side with pipe 8, may be omitted or replaced by a sieve plate directly connected with the wash liquor container. Further the filter may be arranged horizontally. Such an arrangement has the advantage that even with partial filling of the filter chamber the lower filter surface is always completely covered with aluminosilicate, and through-flow without ion exchange in the area of cavities is avoided. The complete evacuation of spent aluminosilicate from the horizontally arranged filter chamber can be facilitated by additionally introducing the outflowing wash liquor into the filling pipe 5.

The arrangement has the disadvantage, a minor one, however, that always only one half of the existing filter surface is available for the actual filtration process. The other half of the filter surface, through which the cycled wash liquor flows into the filter chamber, is not used for filtration in the respective cycle and causes an additional flow resistance.

An arrangement which avoids this disadvantage is illustrated diagrammatically in FIG. II. It consists of the filter jacket 9, within which an outer filter surface 10 and an inner filter surface 11 are arranged, which may consist, for example, of plain filter plates or two concentric filter cartridges. The filter chamber 12 intended to receive the aluminosilicate can be charged with the exchanger through the filling pipe 13 and be evacuated through the drain pipe 14 provided with a valve 15. When using a comparatively fine-grained aluminosilicate, the latter may be alternatively be flushed into the filter chamber via the drain pipe 14. In this case the filling pipe 13 may be omitted. The connections 16 and 17 serve to admit and to remove the cycled cleaning liquid.

Operation of the counter-current filter during the so-called "work cycle" occurs by introducing the circulated cleaning liquid through the inlet 14 into the filter chamber, with valve 15 open, after the aluminosilicate has been placed in the filter chamber 12. The aluminosilicate is maintained in suspension and whirled intensively by the inflowing wash liquid. The liquid passes through the filter surfaces 10 and 11 and leaves the filter in a clarified state through the two connections 16 and 17. The two partial streams are combined and go back into the system. The cleaning of the filter surfaces 10 and 11 from deposited material by flow reversal occurs intermittently. First the valve 15 is closed and the cleaning solution is introduced through the conduit 16. The liquid travels through the filter surface 10, detaches the coating on the inside, passes through the filter surface 11 and flows out through the connection 17. As soon as the filter surface 11 is free of the coating, which usually takes only a few seconds or fractions of a second, the cleaning liquid is let in through the inlet 7 with valve 15 still closed, and after passage through the filter surfaces 11 and 10 is returned to the system via connection 16.

After the cleansing of the filter surface 11, the work cycle starts again, in which the liquid stream is introduced into the filter through inlet 14 with valve 15 open and is let out via the connections 16 and 17. Naturally the sequence during the cleansing may be changed, i.e., first the filter surface 11 and then the filter surface 10 is cleansed. The evacuation of spent aluminosilicate from the filter chamber after termination of the washing process occurs by means of the water flowing in via the connections 16, 17 and possibly also 13 with valve 15 open, via pipe 14.

FIG. III shows a counter-current filter which has proved particularly successful in practice. It consists of two conical housing halves 18 and 19, which are firmly connected together through a flange 20 provided with seal rings and tightening screws. The housing encloses the two outer chambers 21 and 22, which are sealed from each other by the flange. The filter basket 23 consists of a colander type perforated double cone, which imparts the necessary mechanical strength to the filter element applied against the inside, and consisting, for example, of textile material, a fiber mat or a fine wire mesh. The inner filter chamber 24 can be charged with aluminosilicate through the filling pipe 25. When using a sufficiently fine-grained aluminosilicate, the filling may occur also through the drain pipe 27 provided with a cone valve 26. The feed pipe 28 communicates with the outer chamber 21, feed pipe 29 with the outer chamber 22.

The quantity of aluminosilicate should be expediently selected such that the cavity 24 is filled no more than 80%, preferably 20 to 60%. During the so-called work cycle, the circulated cleaning solution is conveyed into the cavity 24 through inlet 27 with valve 26 open, there occurring, due to the construction of the filter, an intensive whirling of the ion exchanger and consequently a rapid and effective ion exchange. After filtration, the liquid enters the two outer chambers 21 and 22, whence the two partial streams, having left the filter, are combined via the connections 28 and 29, and are returned to the material to be cleaned. The cleansing of the filter from deposited material by flow reversal occurs, similarly as with the filter construction of FIG. II, in two steps. First, with valve 26 closed, the liquid is introduced into the outer chamber 21 via connection 28. It passes through the lower filter cone, there detaches the coating, and leaves the filter via the upper filter cone as well as the outer chamber 22 and the connection 29.

For cleansing the upper filter cone, again with valve 26 closed, the liquid is introduced into the outer chamber 22 via connection 29, whence it is then discharged through the lower filter cone via the outer chamber 21 and connection 28. The two steps can, of course, be carried out also in the reverse order. After the cleansing of both filter halves, the work cycle starts anew. Evacuation of the filter chamber after termination of the washing process occurs in that the cleaning or washing liquid is admitted via the connections 28 and 29 and the aluminosilicate is discharged, with valve 26 open, via connection 27 with simultaneous flushing out of the aluminosilicate.

The frequency and duration of the flow reversal or cleansing of the clogged filters depend on a number of factors. When using a fine-grained aluminosilicate, the flow reversal will occur more frequently during a washing process than when using one of coarser grain. On the other hand, when using a fine-grained material, the washing process can take less time in all, due to the faster exchange reaction. Another factor is the construction of the filter. When using a simple counter-current filter according to FIG. 1, filter surfaces of equal size are available in both flow directions, for which reason the same interval of time is expediently selected for the stroke and counter-stroke. But when using a counter-current filter, according to FIG. II, and in particular FIG. III, it will be desirable, in view of the fact that during the intermittent cleansing of the filter surface only half the surface is available for the actual filtration process, to select the work cycle five to ten times as long as the interval for the cleansing of the filter. During a washing and cleaning process where the cleaning liquid is cycled a total of about 30 to 90 minutes, therefore, when using a counter-current filter according to FIG. III, a flow reversal is necessary at intervals of about 2 to 15 minutes, preferably 3 to 10 minutes, the duration of the flow reversal being about 1 to 30 seconds, more particularly 2 to 15 seconds per filter surface.

It is not necessary in all cases to reverse the flow direction by controlled measures, for example, by actuation of switching members. It may suffice to suddenly stop the flow at a suitable point of the conduit system. The back pressure then building up leads briefly to a sudden flow reversal and knocking off of the filter mud.

The point in time of the respective flow reversal during a washing process can be programmed by an automatic control, so that the change of cycle occurs according to a fixed scheme. Alternatively, a pressure-dependent control may be used which records the flow or respectively the flow resistance building up due to increasing clogging of the filter and brings about a reversal of the flow direction when a permissible value is exceeded.

It has been found to be expedient to arrange a second filter in the cycle system in addition to the counter-current filter intended to receive the aluminosilicate exchanger. This so-called dirt filter is to prevent lint and coarse impurities forming during the washing and cleaning process from getting into the counter-current filter, clogging or blocking valves and feed lines, and to remove them beforehand from the cycled cleaning solution. Further the dirt filter can be used for collecting the aluminosilicate discharged from the counter-current filter after termination of the washing process. The collected aluminosilicate is removed from this dirt filter at an easily accessible point and discarded. The dirt filter may have relatively large pores and be penetrable by fine-grained aluminosilicate, as the latter is harmless because of its only slight tendency to deposit in the conduit pipes. Instead of a filter, a correspondingly dimensioned centrifuge, for example, a continuously operating tube centrifuge, may be used.

The execution of the washing process will be explained in the example of the flow diagram shown in FIG. IV. First the filling duct 30 is filled with the aluminosilicate exchanger. Then it is flushed into the filter 33 via the inlet 32 with the aid of the fresh water flowing in from the feed line 31. For reasons of simplified illustration, a counter-current filter according to FIG. I is shown, which, of course, may be replaced by differently designed counter-current filters. The fresh water presoftened by interaction with the ion exchanger, having passed through the filter, runs via the lines 34 and 35 to the switching device 36 and thence via line 37 to the feed device 38 containing the washing or cleaning agent. After dissolution of the washing or cleaning agent, the solution runs via the connection 39 into the cleaning tank 40, which is loaded with the material to be cleaned, and thence via line 41 into the dirt filter 42. The cleaning liquid, freed from coarse dirt particles and lint, flows via the connection 43 to the circulating pump 44, whence it is transported via the valve 45 and line 46 to the switching device 36. Thence it flows alternately via line 34 into the filter 33 and back into line 35, or respectively, after switching, in opposite direction via line 36 into filter 33 and thence via line 35 back again to the switching device. Thereafter the regenerated liquid is again cycled over the line sections or units 37, 39, 40, 41, 42, 43, 44, 45 and 46.

After completing the washing process, the cleaning solution is transported into the sewer mains via the drain pipe 47, valve 45 having been switched. The aluminosilicate is removed from the counter-current filter 33 after valve 48 has been opened. The aluminosilicate goes through line 49 to the dirt filter 42 and is collected there. Discharge of the exchanger and complete evacuation is promoted by maintaining a liquid circulation in the units or conduits 44, 45, 46, 36, 34, 35, 33, 48, 49, 42 and 43 by actuation of pump 44 for a short time. Transfer of the aluminosilicate and cleaning of the counter-current filter can be carried out immediately after termination of the washing process, i.e., before the spent cleaning solution is pumped off. Preferably, however, the procedure is first to remove the bulk of the washing liquid and only then to flush out the counter-current filter. The advantage of the last-named procedure is that the dirt filter is charged with aluminosilicate only after the bulk of the cleaning solution has drained, and clogging of the filter pores is avoided.

Another possibility consists in that the washing or cleaning solution used is pumped off completely, the aluminosilicate being at first left in the counter-current filter, then passing through the fresh water needed for the first and possibly also the second and third rinse cycles. As the exchanger capacity of the aluminosilicate is generally not yet exhausted after the wash cycle, this enables the rinse water to be partially softened. This has an advantageous effect on the so-called secondary wash effect, i.e., the graying and incrustation of the fabric, which is known to increase with the duration of use and the number of launderings, is clearly less than when rinsing with hard water. The aluminosilicate is then discharged from the counter-current filter with the draining rinse water of the first or second rinse cycle and, as shown above, collected on the dirt filter.

The advantage of the arrangement described in FIG. IV is that in the circulation system in which the wash liquor tank, the dirt filter and the circulating pump are installed, the cleaning liquid is transported always only in one direction and a flow reversal occurs only in the counter-current filter. This results in a directed substance transport, starting from the material to be cleaned toward the dirt filter and counter-current filter, whereby an especially good laundry result is obtained. Naturally, the principle illustrated can be varied and modified in many ways.

The invention is not limited to the arrangement represented above. Rather these can be supplemented and modified in many ways. The aluminosilicates used in the process of the present invention can be prepared in simple manner, for example, by reacting a water-soluble silicate with a water-soluble aluminate in appropriate proportions in the presence of water. Thus sodium aluminate solution diluted with deionized water is added to sodium silicate solution. The desired product precipitates. The product when dried at first is amorphous, but turns into a crystalline material after prolonged standing. The formation of large crystal aggregates is enhanced by standing. Vigorous stirring during the precipitation and recrystallization period leads to a finely divided product. After the liquor from the crystal sludge has been drained off and the sludge has been washed with deionized water until the outflowing wash water has a pH of about 10, the filter residue is dried. If necessary, the residue can be ground in a ball mill and separated in a centrifugal sifter into fractions of various particle size. The particle size distribution can be determined by means of a sedimentation balance.

The calcium binding power of the aluminosilicates is determined as follows:

One gram of aluminosilicate was added to one liter of an aqueous solution containing 0.594 gm of $CaCl_2$ (=300 mg CaO/liter=30° dH) standardized with diluted NaOH to 10. Then the suspension was stirred vigorously for 15 minutes at a temperature of 22° C. (±2° C.). After filtering off the aluminosilicate, the residual hardness ("x") of the filtrate is determined. From this value the calcium binding capacity in mg CaO/gm of active substances (=AS) is calculated according to the following formula:

$(30-x).10$, where an anhydrous product which had been heated for one hour at 800° C. is used as active substance. For shorthand purposes this test procedure will be referred to as the Calcium Binding Power Test Method.

The percentages indicated below are percent by weight.

Production Conditions for Aluminosilicate Al

Precipitation:

2.985 kg aluminate solution of the composition: 17.7% $Na_2O$, 15.8% $Al_2O_3$, 66.6% $H_2O$ 0.15 kg caustic soda 9.420 kg water 2.445 kg of a 25.8% sodium silicate solution freshly prepared from commercial waterglass and easily alkali-soluble silica of the composition: 1 $Na_2O.6.0$ $SiO_2$ Crystallization: 24 hours at 80° C.

Drying: 24 hours at 100° C.

Composition: 0.9 $Na_2O.1$ $Al_2O_3.2.05$ $SiO_2.4.3$ $H_2O$ (=21.6% $H_2O$)

Degree of Crystallization: Fully crystalline

Calcium binding capacity: 150 mg CaO/gm of active substance.

The primary particle sizes of the aluminosilicate range from 10 to 45μ with a maximum at 20 to 30μ.

The invention is further illustrated by the examples which follow. These examples are illustrative of the process of the invention. However, they are not to be construed as limitations thereof.

EXAMPLES 1 to 3

The washing apparatus consisted of a washing machine with horizontally mounted front-loading drum having a capacity of 4 kg of dry laundry. According to the diagram shown in FIG. IV, the drain pipe inserted in the bottom of the wash liquor container was connected with a lint filter (dirt filter), from which a conduit led to the wash liquor pump and thence via a multiway cock (switching device) to a double cone filter according to FIG. III. The return line from the filter was integrated in the hollow shaft of the drum, by means of which the wash liquor was conducted directly to the dirty laundry.

The inner chamber of the double cone filter had a volume of about 2000 cc and was loosely filled about 40% when being charged with aluminosilicate. The wash liquor quantity was 20 liters and the delivery of the pump was 10 liters/min., so that the wash liquor was circulated on the average once in about two minutes. After every six minutes circulation of the wash liquor, the flow direction was reversed for ten seconds first in the lower portion and then in the upper portion of the filter. This alternation occurred 15 times in all during the 90-minute washing process. Due to these measures, the filter remained easily penetrable during the entire washing process.

Before the start of the washing process, the fresh water was, as shown diagrammatically in FIG. IV, passed first through the filter charged with aluminosilicate and was thus softened from an initial hardness of 16° dH to a hardness of 4.5° dH. After the cleaning liquid had been pumped off, also the fresh water needed for the first rinse cycle was passed over the aluminosilicate remaining in the counter-current filter, being thereby softened from the initial hardness of 16° dH to 8.5° dH. In the following rinse cycles, the rinse water was conducted directly to the textile material. The flushing out of the aluminosilicate from the counter-current filter and transfer into the dirt filter occurred with the draining rinse water of the fourth rinse cycle, to avoid premature clogging of this filter.

An aluminosilicate was employed which had been prepared similarly to that of Aluminosilicate Al described above and had a particle size of 30 to 100μ with a maximum of 50 to 80μ. The washing machine was loaded with 3 kg of clean fill-up laundry as well as two textile samples each (20×20 cm) of cotton (C), finished cotton (F.C.), and a blend of 50% polyester and 50% finished cotton (P/C), the textile samples having been artificially soiled with skin fat, kaolin, iron oxide black and carbon black. This simulates the soil of naturally soiled garments. The washing temperature was 90° C. for the cotton and 60° C. for the finished cotton and blended fabric.

The following washing agent components and additives in grams per liter of wash liquor were used:

| Grams/liter | |
|---|---|
| 0.5 | Na n-dodecylbenzene sulfonate |
| 0.17 | Ethoxylated tallow fatty alcohol (14 mols ethylene oxide) |
| 0.27 | Na soap (tallow fatty acids/ behenic acid 1:1) |
| 0.015 | Na ethylenediaminetetraacetate (EDTA) |
| 0.25 | Na silicate ($Na_2:SiO_2$ = 1:3.3) |
| 0.11 | Na carboxymethylcellulose (Na CMC) |
| 2.0 | Sodium perborate tetrahydrate |
| 0.15 | Magnesium silicate |
| 0.2 | Sodium sulfate |

The following additional additives were used:

| | Grams/liter | |
|---|---|---|
| (a) | 3.5 | Na tripolyphosphate (TPP) |
| (b) | | No further additions |
| (c) | 0.4 | TPP |
| (d) | 0.4 | TPP |
| | 0.4 | Na citrate |
| (e) | 5.0 | Aluminosilicate (in filter) |
| (f) | 5.0 | Aluminosilicate (in filter) |
| | 0.4 | TPP |
| (g) | 5.0 | Aluminosilicate (in filter) |
| | 0.4 | TPP |
| | 0.4 | Na citrate |

After discharging the wash liquor, the laundry was rinsed with tap water four times and lastly spun dry. The percentage remission values of the textile samples, determined photometrically, were compiled in the following Table I. The abbreviation "P" stands for phosphate.

TABLE I

| Additive Formulation | Characterization | % Remission C | F.C. | P/C |
|---|---|---|---|---|
| a | Comparison, high P | 79 | 80 | 67 |
| b | Comparison, P-free | 57 | 58 | 54 |
| c | Comparison, low P | 55 | 58 | 54 |
| d | Comparison, low P | 57 | 58 | 56 |
| e | Example 1, P-free | 81 | 73 | 71 |
| f | Example 2, low P | 83 | 74 | 73 |
| g | Example 3, low P | 83 | 75 | 73 |

EXAMPLES 4 to 6

In the washing agent formulations of Examples 1 to 3, the Na n-dodecylbenzene sulfonate was replaced by the same amount of ethoxylated oxo-alcohol (a $C_{14}$–$C_{17}$ oxo-alcohol with 12 mols ethylene oxide) and the ethoxylated tallow fatty alcohol with 14 mols of ethylene oxide was replaced by one with 5 mols of ethylene oxide. These washing agent formulations containing exclusively nonionic surface-active compounds (designated b', c', d', e', f' and g') are especially suitable for low phosphate washing agents and for easy care textiles of finished cotton as well as blended fabrics. The other test conditions were the same as in Examples 1 to 3. The results of the washing tests are listed in Table II.

TABLE II

| Example | Additive Formulation | Builders | % Remission C | F.C. | P/C |
|---|---|---|---|---|---|
| — | b' | Without aluminosilicate, no P | 79 | 68 | 60 |
| — | c' | Without aluminosilicate, low P | 80 | 71 | 74 |
| — | d' | Without aluminosilicate, low P | 80 | 72 | 75 |
| 4 | e' | With aluminosilicate, no P | 82 | 78 | 78 |
| 5 | f' | With aluminosilicate, low P | 84 | 80 | 79 |
| 6 | g' | With aluminosilicate, low P | 84 | 79 | 79 |

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A method for machine washing and cleaning of solid materials utilizing washing and cleaning solutions in the presence of water-insoluble cation exchange agents which are capable of binding the hardness components of the water and the soil, comprising withdrawing and recycling the wash liquid in contact with said solid soiled materials through a silicate cation exchange compound having some combined water and a particle size of between 10μ and 1000μ of the formula:

$$(M_{2/n}O)_x \cdot Me_2O_3 \cdot (SiO_2)_y$$

wherein M is a cation of valence n exchangeable with calcium, Me is a member selected from aluminum and boron, x is a number from 0.7 to 1.5 and y is a number from 0.8 to 6, said agent having a calcium binding power of at least 50 mg of CaO per gram, said silicate cation exchange compound being maintained completely out of contact with said solid soiled materials in a separate area from the washing area, said wash liquor at some time during said recycling containing soluble washing and cleaning compounds and washing said solid materials while continuing the recycling of the wash liquor through said silicate cation exchange compound, wherein the total amount of washing liquor is continuously or intermittently cyclically circulated from the washing area through the separate area with the cation exchange compound and then back to the washing area at least five times during the cleaning process, and during this period the direction of flow of said wash liquor through said silicate compound is reversed repeatedly, and where the amount of the cation exchange compound is 0.2 gm to 10 gm per liter of washing solution, and said washing solution contains from 0.2 to 10 gm per liter of other soluble washing and cleaning compounds, whereby said silicate cation exchange compound is never in contact with said solid materials.

2. The method of claim 1 wherein said silicate cation exchange compound has a particle size of over 20μ.

3. The method of claim 1 wherein said silicate cation exchange compound has a particle size of from 30μ to 1000μ with a maximum in the range of from 50μ to 200μ.

4. The method of claim 1 wherein said wash liquor flowing from said washing area to said separate area is filtered.

5. The method of claim 4 wherein, after said soiled solid materials are cleaned, said silicate cation exchange compound in said separate area is transferred to said filter step between said washing area and said separate area without passing into said washing area.

6. The method of claim 1 wherein said solid soiled materials are textiles.

7. The method of claim 1 wherein said silicate cation exchange compound has a calcium binding power of from 100 to 200 mg CaO/gm.

8. The method of claim 1 wherein said silicate cation exchange compound has the formula:

$$(Na_2O)_{0.7-1.5}.Al_2O_3.(SiO_2)_{1.3-3.3}$$

9. The method of claim 1 wherein said silicate cation exchange compound is crystalline.

10. The method of claim 1 wherein said other soluble washing and cleaning compounds include an anionic surface-active compound.

11. The method of claim 1 wherein said other soluble washing and cleaning compounds include a nonionic surface-active compound.

12. The method of claim 1 wherein said other soluble washing and cleaning compounds include a water-soluble sequestering agent for calcium ions.

* * * * *